US007770736B2

(12) United States Patent
Jameson

(10) Patent No.: US 7,770,736 B2
(45) Date of Patent: Aug. 10, 2010

(54) METHOD AND APPARATUS FOR FROTH WASHING IN FLOTATION

(75) Inventor: Graeme John Jameson, Callaghan (AU)

(73) Assignee: Newcastle Innovation Limited (AU)

( * ) Notice: Subject to any disclaimer, the term of this patent is extended or adjusted under 35 U.S.C. 154(b) by 0 days.

(21) Appl. No.: 12/093,099

(22) PCT Filed: Nov. 8, 2006

(86) PCT No.: PCT/AU2006/001548

§ 371 (c)(1),
(2), (4) Date: May 8, 2008

(87) PCT Pub. No.: WO2007/053879

PCT Pub. Date: May 18, 2007

(65) Prior Publication Data

US 2008/0230447 A1 Sep. 25, 2008

(30) Foreign Application Priority Data

Nov. 8, 2005 (AU) ..... 2005906176

(51) Int. Cl.
*B03D 1/14* (2006.01)

(52) U.S. Cl. ..... 209/168; 209/164

(58) Field of Classification Search ..... 209/164, 209/168

See application file for complete search history.

(56) References Cited

U.S. PATENT DOCUMENTS

| | | | | | |
|---|---|---|---|---|---|
| 3,339,730 | A | * | 9/1967 | Boutin et al. | 209/166 |
| 4,964,576 | A | | 10/1990 | Datta | |
| 4,997,549 | A | * | 3/1991 | Atwood | 209/164 |
| 5,167,798 | A | * | 12/1992 | Yoon et al. | 209/170 |
| 5,431,286 | A | | 7/1995 | Xu et al. | |

FOREIGN PATENT DOCUMENTS

| | | |
|---|---|---|
| WO | WO 93/20945 | 10/1993 |
| WO | WO 01/60523 | 8/2001 |

OTHER PUBLICATIONS

International Search Report dated Dec. 18, 2006 issued in corresponding PCT Application No. PCT/AU2006/001548.

* cited by examiner

*Primary Examiner*—Thomas M Lithgow
(74) *Attorney, Agent, or Firm*—Ostrolenk Faber LLP

(57) ABSTRACT

A method and apparatus for introducing wash water into a flotation froth in a flotation separation system, where the wash water is injectioned into the froth in the form of a horizontal sheet of water. The sheet is typically formed by impinging a downwardly directed liquid jet issuing from a nozzle onto a horizontal plate or disc where it changes direction and travels radially outwards as an axi-symmetric planar liquid jet or sheet. The depth of the disc can be adjusted by a support rod. Other embodiments are described where the horizontal sheet is ejected through a horizontal slit, or where the sheet of wash water is rectangular rather than axi-symmetric.

9 Claims, 7 Drawing Sheets

Figure 6(a)
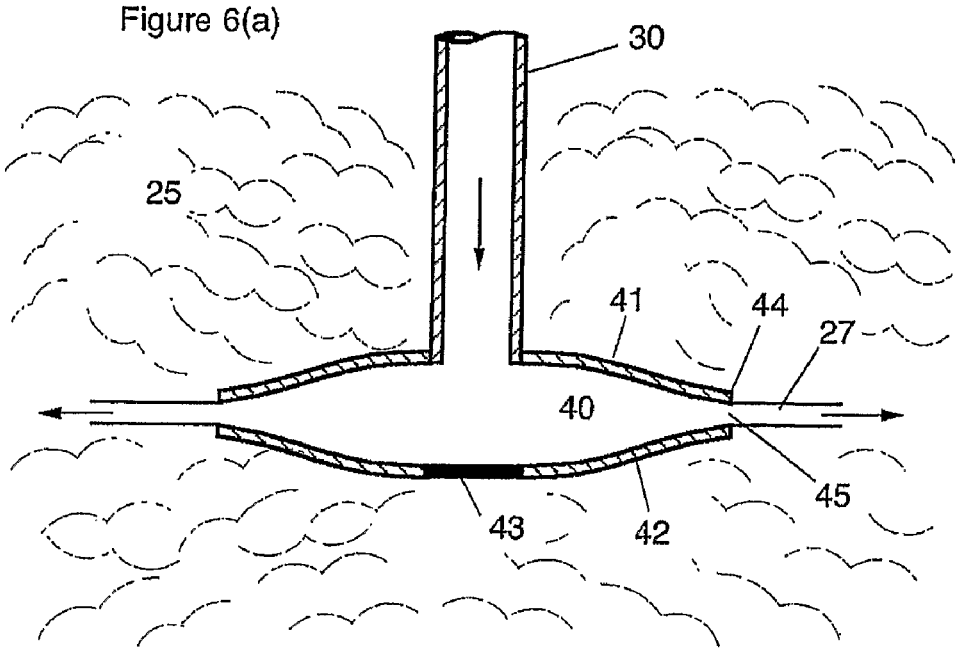
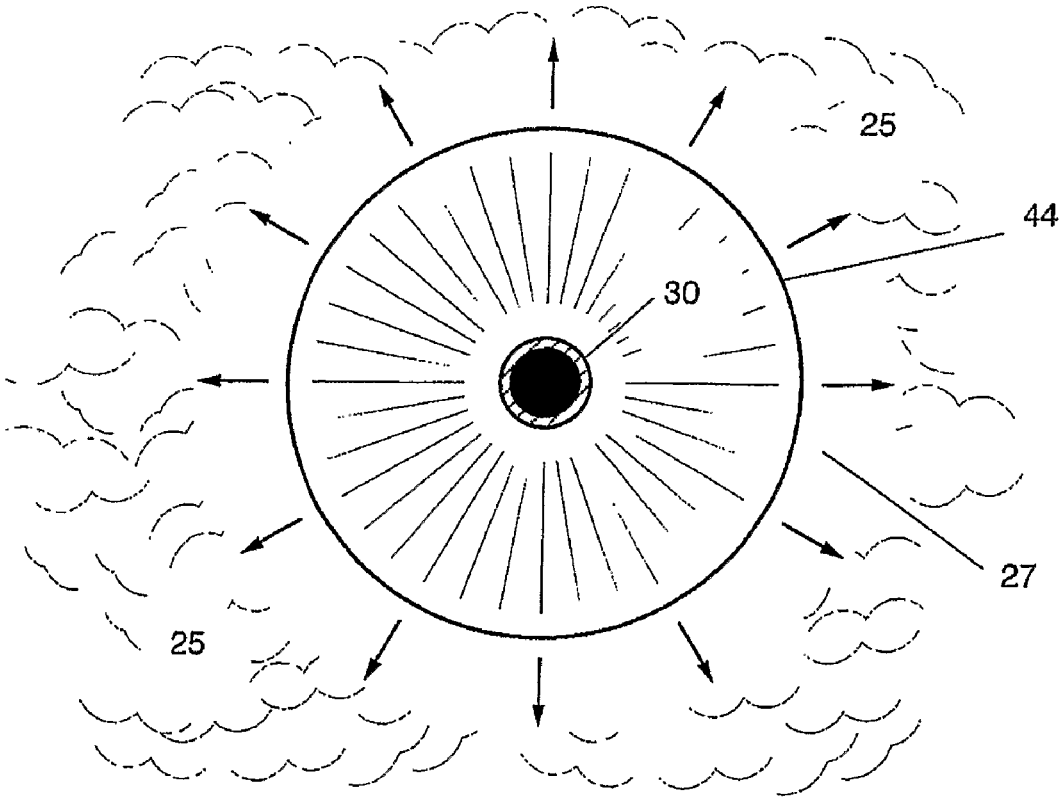
Figure 6(b)

METHOD AND APPARATUS FOR FROTH WASHING IN FLOTATION

CROSS REFERENCE TO RELATED APPLICATIONS

The present application is a 35 U.S.C. §§371 national phase conversion of PCT/AU2006/001548, filed Nov. 8, 2006, which claims priority of Australian Patent Application No. 2005906176, filed Nov. 8, 2005, the disclosure of which has been incorporated herein by reference. The PCT International Application was published in the English language.

FIELD OF THE INVENTION

This invention relates to the flotation process for the separation of particles. In particular it relates to the introduction and distribution of liquid in flotation froths.

BACKGROUND OF THE INVENTION

Flotation is a known process for separating valuable minerals from waste material, or the recovery of finely-dispersed particles from suspensions in water. Typically, an ore as mined consists of a relatively small proportion of valuable mineral disseminated throughout a host rock of low commercial value (gangue). The rock is crushed or finely ground so as to liberate the valuable particles (values). The finely-ground particles are suspended in water, and reagents may be added to make the surfaces of the values non-wetting or hydrophobic, leaving the unwanted gangue particles in a wettable state. Air bubbles are then introduced into the suspension. A frother may be added to assist in the formation of fine bubbles and also to ensure that a stable froth is formed as the bubbles rise and disengage from the liquid.

In the flotation cell, the values adhere to the bubbles, which carry them to the surface and into the stable froth layer. The froth discharges over the lip of the cell, carrying the values. The waste gangue remains in the liquid in the cell and is discharged with the liquid to a tailings disposal facility.

In some applications, particularly when flotation is carried out in tall columns, the froth layer can be relatively deep, of the order 1 to 2 metres. The particles in the froth can be from several sources. Most are hydrophobic particles, the values, which are attached to the bubbles. In addition, liquid is entrained when the bubbles rise from the liquid layer into the froth layer, and this liquid can contain high concentrations of the gangue material, which can pass out of the flotation cell with the valuable material, and accordingly will lead to a reduction in purity of the product. To reduce the mass of contaminating gangue material in the flotation product, a stream of clean wash water can be introduced into the rising froth, thereby providing a net downflow of water in the froth, which flushes out the particles of gangue. It is advantageous to provide a means to introduce wash water in an efficacious way, as uniformly as possible across the cross-section of the flotation column. Devices that are in current use are relatively simple, consisting of horizontal tubes or pipes with small holes drilled at regular intervals from which jets of water issue, into or on top of, the froth. The holes may be drilled in a line along the bottom of the pipe with a pitch of 50 to 100 mm typically, so that the water jets project vertically downwards. Alternatives are known where the jets project in the horizontal direction or at an angle of 45° to the vertical. Another form of washing unit is a horizontal tray suspended over the top of the froth, from which wash water passes through an array of small holes drilled in the base of the tray.

In this case, the water jets project vertically downwards. Whether the holes are formed in the base of a horizontal tray, or in the walls of cylindrical pipes suspended above or within the pipes, a large number of holes is required, to deliver the desired flow rate of wash water. Many holes are needed because of a desire to distribute the wash water as evenly as possible across the flotation column. The optimal distribution would involve essentially an infinite number of injection points but such an arrangement is ruled out for reasons of practicality. Accordingly, designers have adopted the strategy of providing a multiplicity of wash water streams, the number of streams being a balance between the desire to keep the spacing between them to a minimum, while keeping the diameters of the exit holes or orifices as large as possible, to reduce the probability of blockage by particle deposition. Cost is also an issue because the greater the number of holes the larger the manufacturing cost.

The water that is available in mineral concentrators and mills is usually process water that has been recycled after passing through thickeners or settling ponds, and it frequently contains particulate matter that can block the small holes in the wash water distribution systems. Further, processes are known in which hydrophobic particles are deliberately introduced in the wash water, so that they may be captured in the froth layer. Such processes are particularly applicable to particles that are larger than those normally treated by flotation, so large that it is difficult for them to transfer into the froth from the underlying liquid layer. These larger particles settle rapidly in the wash water. The problem is particularly vexatious when it is desired to operate at low wash water flow rates, because under these conditions, the velocity of the water in the distribution pipes is insufficient to keep the particles in suspension and they fall to the bottom of the pipe and accumulate to form a bed of sediment that blocks the small exit holes. Changing the location of the exit holes does not prevent blockage, but merely delays the onset of blockage for the time necessary for a the level of the bed of particles that have sedimented out of the incoming wash water stream, to reach the location of the exit holes.

Throughout this specification the term "wash water" is used to designate the liquid introduced into the froth in this manner, whether it is used for "washing" or for conveying course particles or other matter.

Another factor that must be taken into account is the effectiveness of single streams of water, in the form of essentially cylindrical jets, in washing the froth. Although froths are known that are upwards of one metre in depth, it is also common for froths to be no more than 100 mm deep. When a vertical jet is introduced into a froth, it initially creates a region in the vicinity of the entry point which has a much higher liquid fraction (volume of liquid as a fraction of the total volume of liquid and gas bubbles) than the bulk of the froth. As the wash water flows downwards, it also tends to spread horizontally, until at some distance below the injection point the liquid fraction in a horizontal plane across the column cross-section is essentially constant. We have found that with vertical cylindrical jets the vertical distance required for a constant distribution to be reached is quite large, of order 0.5 to 0.8 m. Thus in shallow froths, much of the wash water will pass through the froth layer to the liquid layer beneath, without providing the desired washing action in the froth.

SUMMARY OF THE INVENTION

In one aspect the present invention provides a method of introducing wash water into a flotation froth in a flotation separation system, said method comprising the steps of providing one or more distribution heads located at one or more predetermined depths within the flotation froth, the or each head being configured to eject a stream of wash water in one or more substantially horizontal sheets, and providing a supply of wash water to the distribution heads such that wash water is injected from the heads into the flotation froth in one or more substantially horizontal sheets.

In one form of the invention the wash water is supplied to each distribution head in a downwardly moving stream and directed outwardly into the substantially horizontal sheet by impinging the downwardly moving stream upon a substantially horizontal plate.

Preferably the downwardly moving stream comprises a downwardly directed jet of wash water.

In one form the substantially horizontal sheet of wash water comprises an axi-symmetric planar liquid jet.

In some cases the substantially horizontal sheet of wash water may be made up of a plurality of substantially co-planar subsheets or streams.

In another form of the invention the or each distribution head includes a chamber arranged to receive the supply of wash water, and one or more horizontally extending slots in a wall of the chamber through which the stream of wash water is ejected in one or more substantially horizontal sheets.

In a further aspect the present invention provides apparatus for introducing wash water into a flotation froth in a flotation separation system, said apparatus including:

supply means arranged to receive a supply of wash water to the apparatus, director means configured to direct the supply of wash water such that it is ejected from the apparatus in use in one or more substantially horizontal sheets, and location means arranged to position the substantially horizontal sheet or sheets at a predetermined depth within the flotation froth.

Preferably the supply means directs the supply of wash water in a downwardly moving stream.

In one form of the invention the supply means includes a downwardly facing nozzle and the downwardly moving stream comprises a downwardly plunging jet of wash water directed by the nozzle.

Preferably the director means comprises a substantially horizontal plate located below the nozzle such that the jet impinging on the plate is directed outwardly in the substantially horizontal sheet.

Preferably the plate is located below the nozzle by way of a rod extending vertically upwardly from the plate and passing through the nozzle.

Preferably the rod is vertically adjustable relative to the nozzle forming the location means arranged to position the substantially horizontal sheet at the predetermined depth within the flotation froth.

Alternatively the supply means includes a substantially vertically oriented pipe and the director means comprises a substantially horizontal plate located below the lower end of the pipe such that the wash water is emitted from the pipe in a jet impinging on the plate and is directed outwardly in the substantially horizontal sheet.

Preferably the plate is substantially flat.

Alternatively the plate has a broad angle conical upper surface with the apex centrally positioned below the outlet from the pipe.

In another form of the invention the supply means includes a substantially vertically orientated pipe communicating with a chamber at a lower end of the pipe, the chamber including one or more horizontally extending slots in a wall of the chamber through which the stream of wash water is ejected in one or more substantially horizontal sheets.

In one embodiment the chamber is formed from a downwardly concave upper disk, and an upwardly concave lower disk of corresponding size, arranged with their peripheries aligned and spaced apart by a small gap forming the horizontally extending slot.

Optionally one or both of the discs are formed of flexible material allowing the slot to expand as required to eject particles contained in the wash water passing therethrough.

Preferably the pipe communicates with the chamber at the centre of the upper disc, and the lower disc incorporates a substantially horizontal rigid plate located below the outlet from the pipe.

In one form the chamber is prismatic in plan view, with opposite parallel walls incorporating said horizontally extending slots.

BRIEF DESCRIPTION OF THE DRAWINGS

The invention will now be described with reference to the accompanying drawings in which:

FIG. 6(*a*) is a cross-sectional elevation and FIG. 6(*b*) is a plan view of a further embodiment of wash water distribution head.

FIG. 8(*c*) is a vertical cross-section on the line 1-1 of FIG. 8(*a*), and FIG. 8(*d*) is a vertical cross-section on the line 1-1 of FIG. 8(*a*), of an alternative embodiment.

DETAILED DESCRIPTION

Surprisingly, it has been found that when the wash water is introduced in a substantially horizontal plane in the froth, in the form of a planar jet, such wash water mixes readily with the froth in a relatively shallow region. Thus it is able to accomplish the purpose of wash water addition, which is to dilute and replace the water rising out of the liquid layer in the flotation cell, by clean water. Throughout this specification and claims the term "substantially horizontal" is used in a broad sense, recognising that it is intended to cover significant variations from the horizontal which will have a similar effect to the ejection of a horizontal sheet of wash water.

Figure 1:
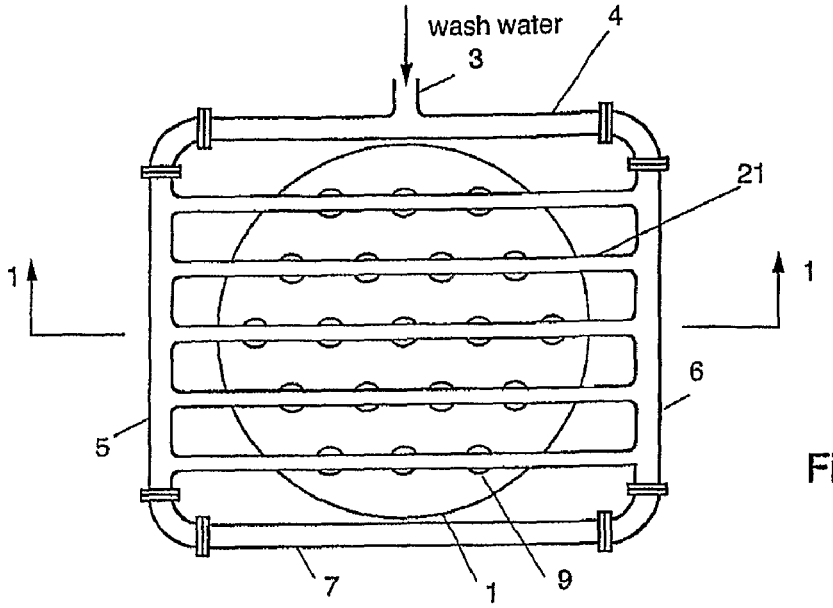
FIG. 1 is a plan view of a flotation column with a wash water distribution system according to the invention.
Figure 2:
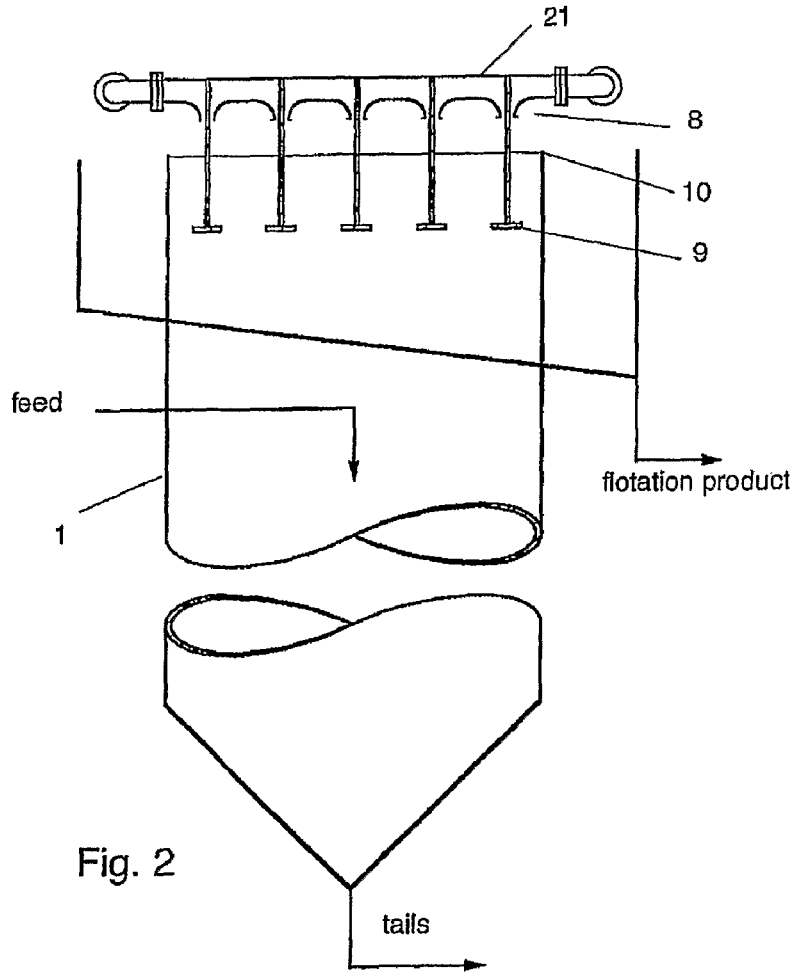
FIG. 2 is a cross-sectional elevation along the line 1-1 of FIG. 1.

FIGS. 1 and 2 show the arrangement of a wash water system according to the invention, mounted on a cylindrical flotation column. Mounted above the column 1 is a manifold system for providing water to each of the wash water distribution heads 9. A water supply pipe 3 joins a horizontal distribution pipe 4 connected at the ends to manifold pipes 5, 6 which in turn are connected to a distribution pipe 7. Transverse delivery pipes 21 run between the manifold pipes 5 and 6, and at suitable points, a multiplicity of off-take nozzles 8 is provided, to deliver water to the wash water distribution heads 9 that are mounted at the desired position below the froth overflow lip 10 of the flotation column 1.

Figure 3:
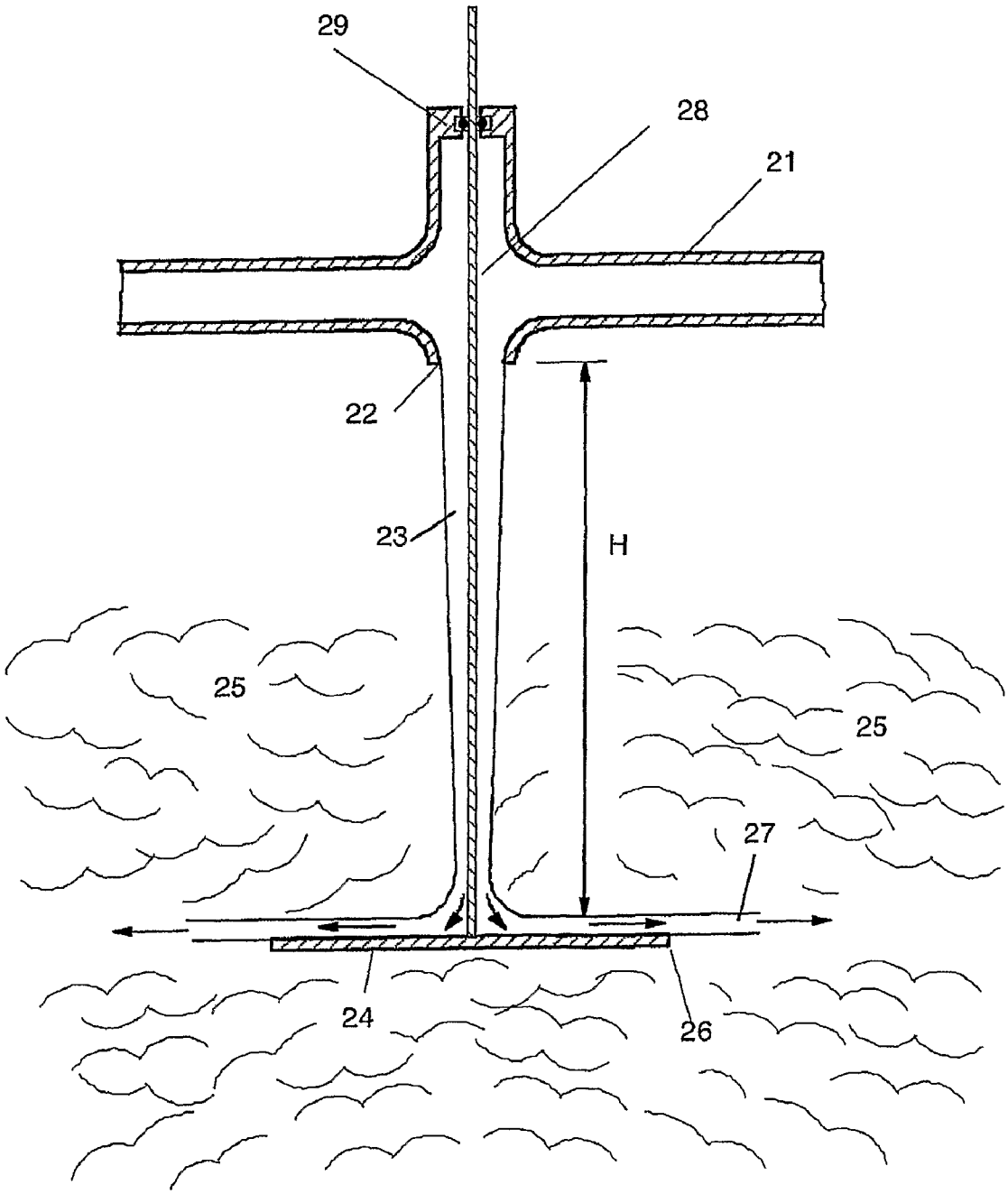
FIG. 3 is a cross-sectional elevation to an enlarged scale of a preferred embodiment of a wash water distribution head according to the invention.

FIG. 3 shows a preferred embodiment of the wash water distribution heads according to the invention. The term "head" is used herein to refer to the outlet from the apparatus where the wash water is injected into the froth. Wash water is delivered to the flotation cell through a manifold pipe 21, which is capable of supplying water to a multiplicity of locations over the cross-sectional area of the flotation column as shown in FIG. 1. The water flows through a nozzle 22 in the form of a liquid jet 23, and travels downwards under the action of gravity to strike a plate in the form of horizontal circular disc 24 that is immersed in the foam or froth layer 25. On striking the disc 24, the water changes direction and travels radially outwards in essentially a horizontal direction, and on leaving the disc at the outer extremity 26, it issues essentially as a substantially horizontal sheet in the form of an axi-symmetric planar liquid jet 27.

The disc is suspended by a rod 28 held by a suitable restraining means whose function is to allow the distance H from the nozzle 22 to the upper surface of the disc 24 to be varied. The velocity U of the water in the jet striking the surface of the horizontal disc 24 is given by the equation $U^2=U_0^2+2\,gH$, where $U_0$ is the velocity of the jet as it leaves the orifice 22, g is the acceleration due to gravity, and H is the distance fallen by the water. The velocity of the planar jet 27 leaving the disc 24 in the horizontal direction is essentially the same as the vertical velocity of the liquid jet as it strikes the centre of the disc. It is useful to be able to vary the height H so as to vary the velocity of the impinging jet 23 and hence the velocity of the circular planar jet 27, while maintaining the same wash water flow rate.

It will be appreciated that although the horizontal sheet of wash water has been described as a continuous sheet, it could be made up of a plurality of substantially co-planar subsheets or streams. These may for example be slightly angled relative to one another, staggered in height, or separated by small gaps.

One advantage of the device over existing means for distributing wash water is that the system is self-cleaning. The distance between the inner surface of the orifice 22 and the outer surface of the support rod 28 is designed to be much larger than the size of the largest particles in the wash water stream, so the orifice will not block. Any particles that settle on the surface of the disc 24, will be washed away by the stream of water from the jet 23. The velocity of this stream can be made independent of the flow rate, by suitable adjustment of supporting rod 28 to give the desired velocity. The supporting rod 28 has an additional function in that it tends to guide the jet 23 so that it falls centrally on the surface of the disc 24. The rod is a convenient way of holding the disc 24 in place, but any other suitable means can be used, that has the effect of maintaining the disc in a fixed horizontal plane, and preferably allowing the adjustment of the distance H.

It will be appreciated that the distributor pipe 21 could be placed within or above the froth. The distribution pipe 21 can with advantage be constructed in such a way that it can be raised or lowered relative to the lip 10 of the flotation cell, so as to change the depth below the lip at which the wash water is injected horizontally into the froth.

In operation, it has been found that the optimum velocity of the jet formed by the planar sheet of wash water should be in the range 0.1 to 12 m/s, and more particularly, in the range 0.3 to 3 m/s. If the jet velocity is too low, the wash water does not penetrate and mix with the froth, while if it is too high, the momentum in the liquid in the planar jet sends the wash water too far in a horizontal direction for efficient mixing with the froth. The thickness of the planar sheet of wash water is determined by the flow conditions and the geometry of the formation device, and is conveniently in the range 0.1 to 10 mm, but more particularly in the range 0.5 to 3 mm.

Figure 4:
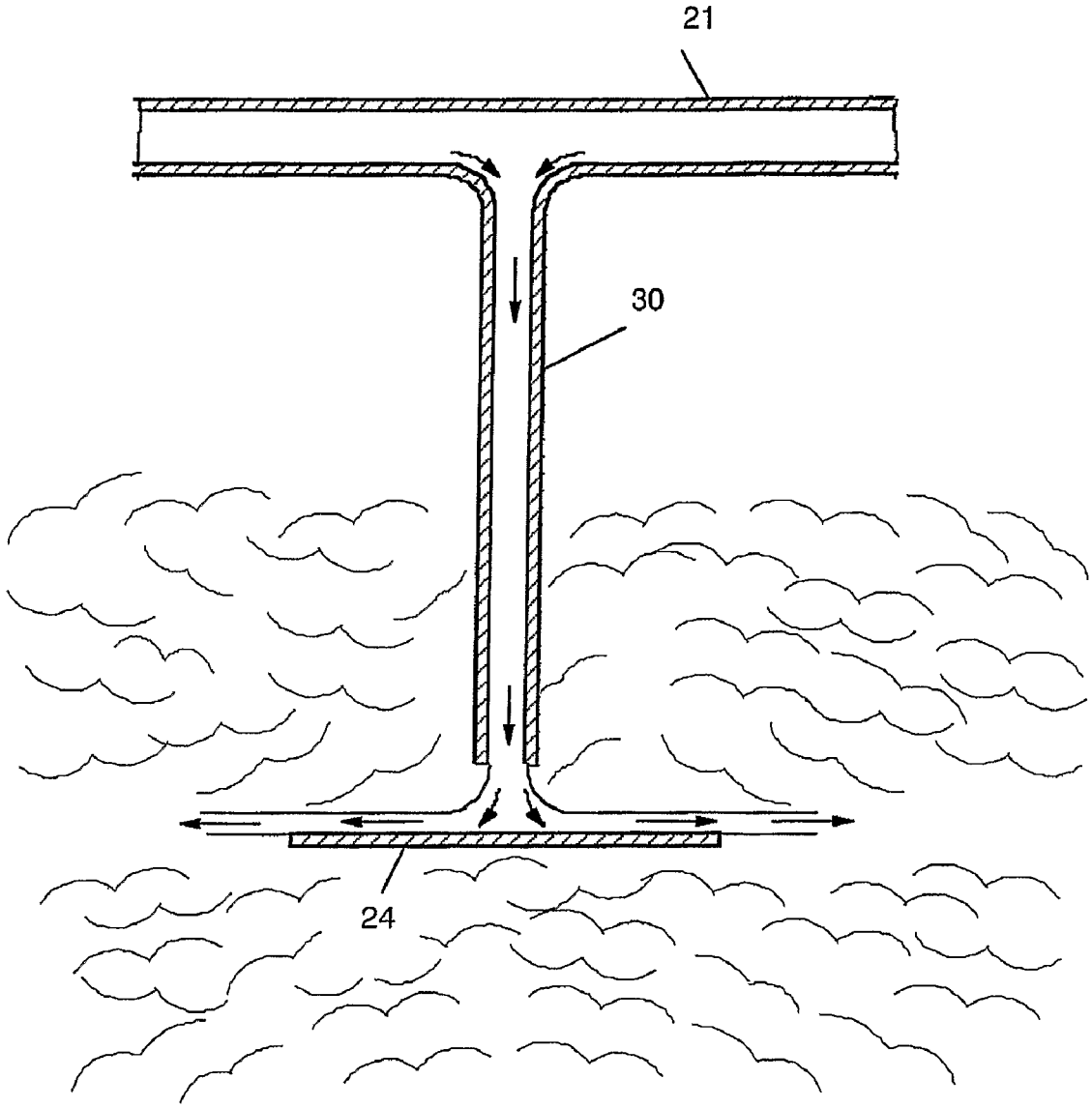
FIG. 4 is a cross-sectional elevation of an alternative embodiment of wash water distribution head.
Figure 5:
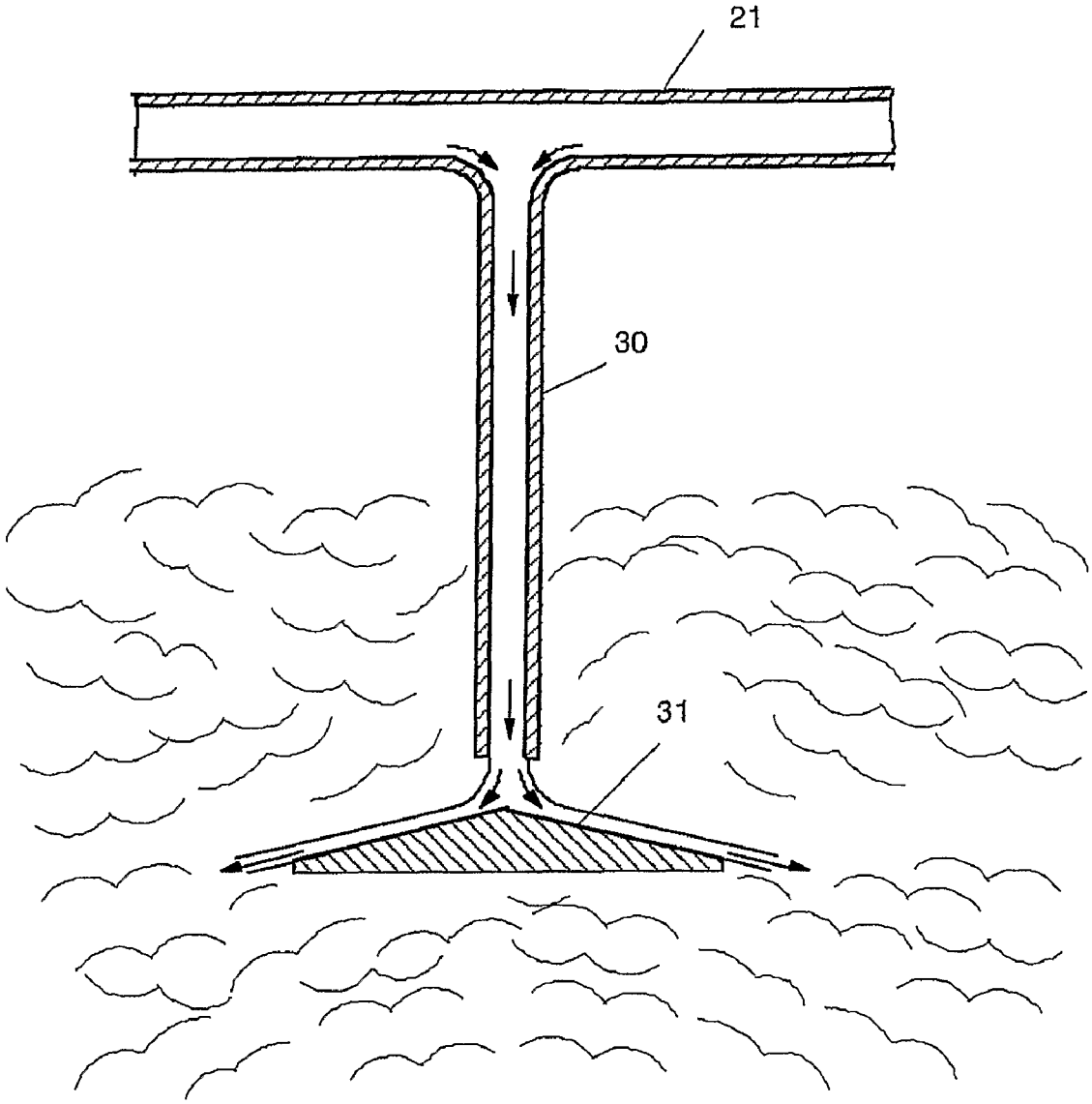
FIG. 5 is a cross-sectional elevation of yet another embodiment of wash water distribution head.

An alternative embodiment is shown in FIG. 4, where the wash water is supplied from a delivery pipe 21 to the centre of the disc 24 by a substantially vertically orientated pipe 30. The advantages of the system shown in FIG. 4 are maintained, in that the stream of water flowing over the plate or disc 24 will sweep away particles that have settled on the surface of the disc. This embodiment can be used where it is desired to deliver the wash water to the disc 24 in a closed conduit. Where large particles may occur in the wash water, an alternative arrangement can be used as shown in FIG. 5 in which the upper surface of the impingement disc has a small slope 30 away from the centre forming a broad angle conical upper surface, thus encouraging any sediment that may tend to form to be swept away under the combined influence of gravity and the stream of wash water.

Another alternative arrangement is shown in FIG. 6(*a*) and FIG. 6(*b*). The wash water is delivered through a pipe 30 and passes into a chamber 40 between two concentric discs 41 and 42, whose surfaces may be contoured as shown wherein the upper disc 41 is downwardly concave and the lower disc 42 is upwardly concave. Either or both of the discs are formed in whole or in part from a flexible material, such as rubber sheet. The discs are essentially circular in form, with a central hole so that the upper disc 41 can be attached to the entry pipe 30, which is fixed in space; and the lower disc can be attached to a substantially horizontal rigid impingement plate 43. The water flows radially outwards, and it is found that the pressure in the chamber 40 between the discs 41 and 42 is less than the pressure in the froth 25 surrounding them. The difference in pressure arises from the well-known principle of Bernoulli, which states that on a streamline in flowing fluid, the sum of the static pressure head and the velocity head is a constant. Thus an increase in velocity in a stream is accompanied by a reduction in pressure along the streamline, so the pressure in the flowing stream approaching the horizontally extending slot formed by exit gap 45 is lower than the pressure in the surrounding foam. Accordingly, the two discs experience a force that tends to push them closer to each other, thus narrowing the slot 45 at the outer extremity of the discs, with consequent increase in velocity which reinforces the pressure field tending to push the two discs together.

The upper disc is fixed relative to the entry pipe 30, while the flexible annular component of the lower disc is fixed to a stationary central plate 43, which is conveniently in the form of a circular disc supported by means not shown. The plate or disc 43 also serves as an impingement plate to provide the reactive force necessary to oppose the vertical force exerted by the liquid as it changes direction from the vertical to the essentially horizontal direction as it flows outwards between the discs 41 and 42. It has been found in practice that at the outer extremity 44 of the discs 41 and 42, the gap between them 45 can approach a very small dimension, and high liquid velocities are created, leading to a significant penetration distance of the horizontal sheet of water into the froth. If a particle in the flow is too large to pass through the gap 45, it will be subject to a large drag force by the fluid flowing radially outwards, and since one or both of the discs 41 and 42 are flexible, they will move to increase the size of the gap in the vicinity of the particle. An increase in the size of the gap will lead to a reduction in the velocity and hence a reduction in the force pushing the two discs together. Accordingly the particle can be forced outwards without causing a permanent blockage in the system.

In the embodiment shown in FIGS. 6(*a*) and 6(*b*), the impingement plate 43 is held in place by means not shown. An important feature of this embodiment is that the parts of one or other or both of the enclosing discs 41 and 42 that are at the largest distances from the axis, should be flexible. This enables the bounding walls 41 and 42 to move closer together in response to the deficiency in pressure that arises from the difference in velocity between the liquid in the space 40, and the liquid in the jet 27, and accordingly increase the velocity of the jet. In a variation of this embodiment, both enclosing discs 41 and 42 are rigid. The upper disc 41 is connected to the delivery pipe 30, while the lower surface 42 is attached to the impingement plate 43, which is allowed to move up and down on the vertical axis of the system, by means not shown. The extent of movement of the lower rigid disc is limited by suitable mechanical means, so that when the wash water flow rate is zero, the gap 45 is finite, and at size that is typically twice the value when the wash water flow rate is at a normal operational value. When the wash water flow rate is increased from rest, the lower disc 42 experiences a force tending to move it closer to the upper disc 41, because of the difference in pressure across its inner and outer faces, due to the Bernoulli effect. The velocity of the liquid in the exit gap 45 increases accordingly, further pulling the two discs together, and allowing the sheet of wash water that exits at high velocity in the radial direction to penetrate and mix with the froth.

Since each of the embodiments shown in FIGS. 1 to 6(*b*) is symmetrical about an axis, the sphere of action of each of them and the sheet of wash water issuing from each is a circle whose radius depends essentially on the velocity and flow rate of the wash water. The area of a flotation column may be so large that a single distribution disc is unable to supply sufficient wash water. Accordingly, it may be preferable to provide an array of wash water distributors, spread across the cross-section of the flotation column or cell, each connected to a manifold supply system as shown in FIG. 1.

Figure 7A:
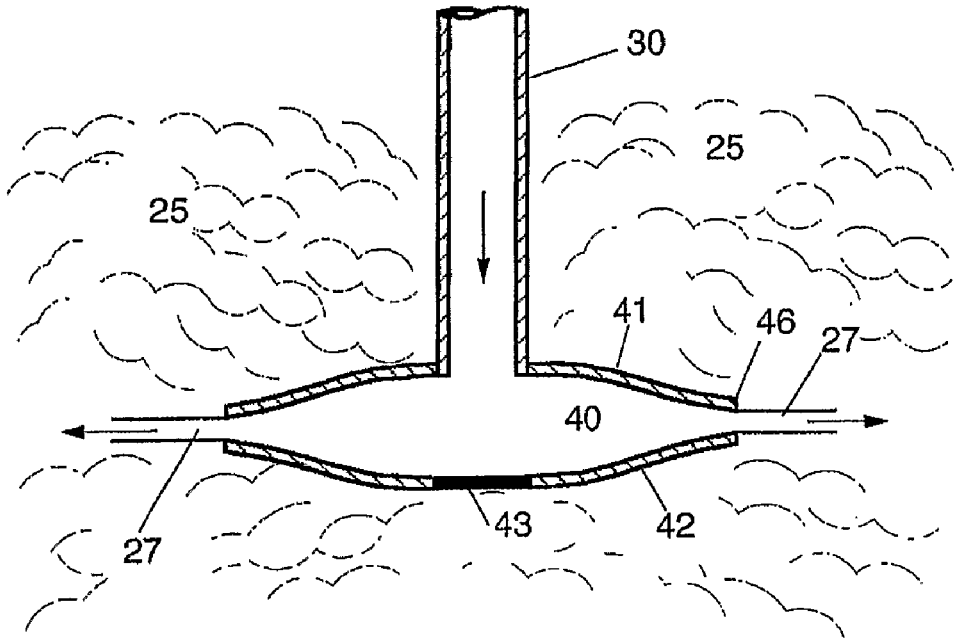
FIG. 7(*a*) is a cross-sectional elevation and FIG. 7(*b*) shows a plan view of an embodiment similar to FIG. 6 but having a rectangular configuration.
Figure 7B:
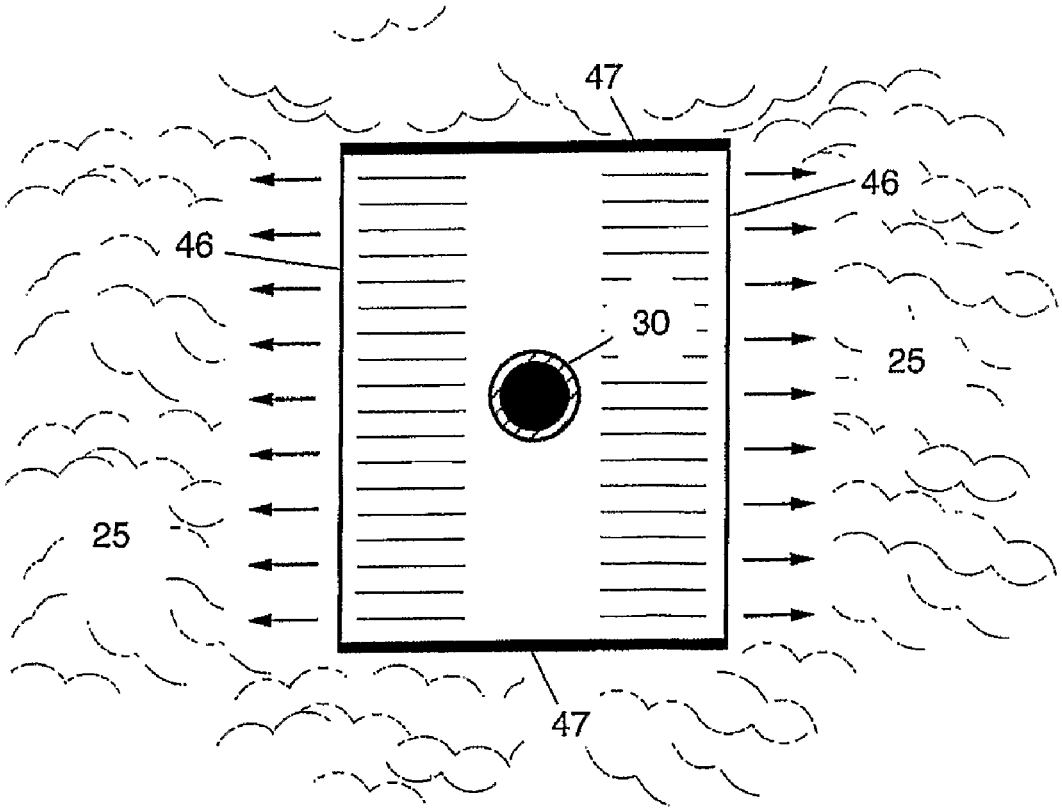
Figure 8A:
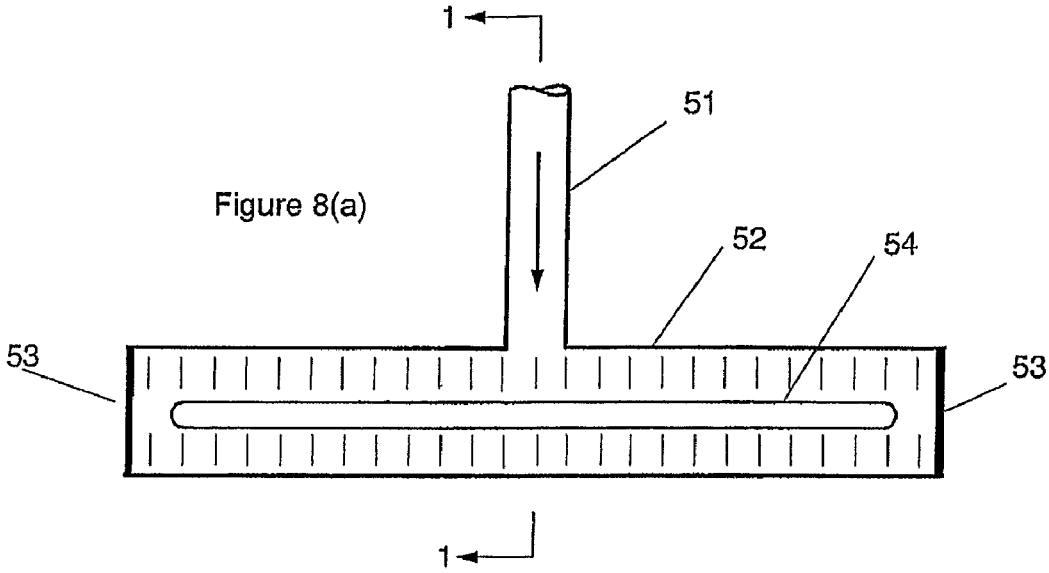
FIG. 8(*a*) is a cross-sectional elevation and FIG. 8(*b*) is a plan view of a further embodiment of wash water distribution head.
Figure 8B:
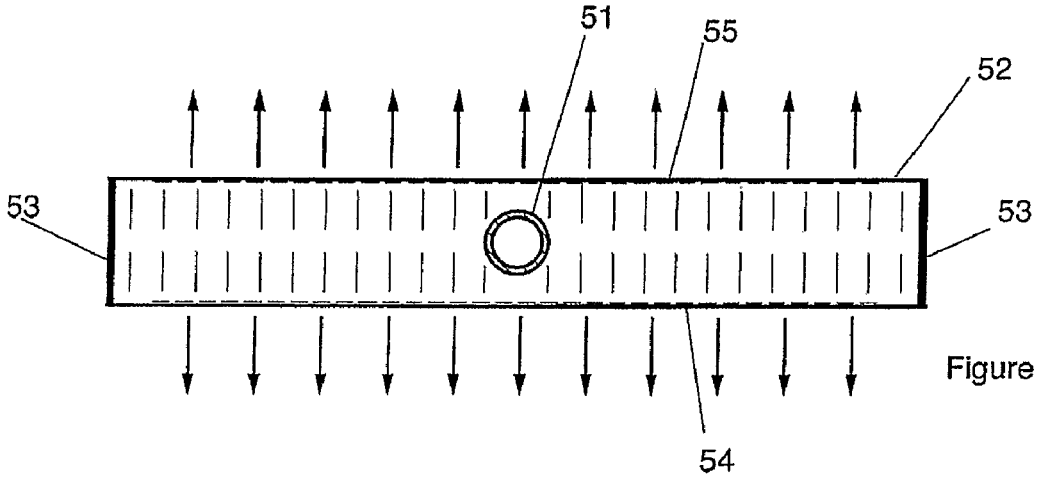
Figure 8C:
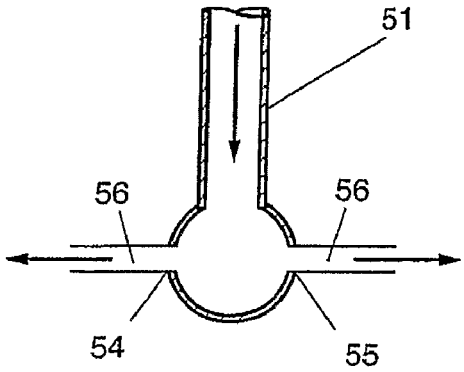
Figure 8D:
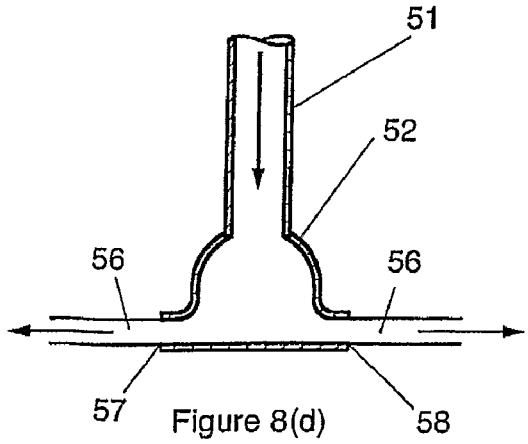

Although the invention has been described in terms of the creation and spreading of a horizontal axi-symmetric planar jet that spreads radially outwards, it will be appreciated that similar advantages can be realised if the planar jet is essentially two-dimensional in nature. Thus FIGS. 7(*a*) and 7(*b*) show the elevation and plan view respectively of an embodiment of the invention in which the wash water issues through rectilinear slits 46 bounded by walls 47 suitably placed. One or other of the upper and lower walls 41 and 42 may be flexible or rigid. Alternatively, both walls 41 and 42 may be rigid, an embodiment that is particularly relevant in cases where the wash water does not contain particulates that may settle in the enclosed space 40. In such cases, the slits may be cut with advantage on a horizontal diametral plane of a horizontal distributor pipe place within the froth at an appropriate level.

Such an embodiment is shown in FIGS. 8(*a*) to 8(*d*). The wash water flows through the pipe or tube 51 and enters the wash water distributor chamber 52 which can conveniently be made in the form of a cylindrical tube sealed at each end with a plug 53. Slits 54 and 55 are machined in the wall of the tube 52 at opposing positions on a horizontal plane. The wash water issues from the slits as liquid sheets 56 that pass into the froth essentially in a horizontal direction. FIGS. 8(*a*) and 8(*c*) show the slits lying on an opposed horizontal diametral position across the cross-section of the distributor 52. However, it is not necessary for the slits to lie on the same horizontal plane, nor must they lie on a diameter of the cross-sectional area of the distributor. For example, in the embodiment shown in FIG. 8(*d*), openings 57 and 58 are formed in the lower part of the distribution pipe 52. In some circumstances, for example, where a distributor pipe 52 is close to the wall of the flotation column, it may be convenient to dispense with a slit that would direct the horizontal wash water directly at the wall of the column, and in such cases, the openings in the distributor pipe 52 would be constructed so as to direct the wash water away from the column wall, by for example eliminating one of the slits 54 or 55, or 57 or 58.

Example

The wash water rate applied to flotation froths is expressed in terms of the superficial velocity, that is, the volumetric flow rate of wash water (cubic metres per second) divided by the cross-sectional area of the froth column (square metres). The superficial wash water velocity can be in the range 0.05 to 3 cm/s, and more generally in the range 0.05 to 0.4 cm/s.

An embodiment of the invention was successfully implemented in a cylindrical column of internal diameter 300 mm. Four injectors according to FIG. 3 were constructed. The diameter of the disc 26 was 30 mm; that of the rod 28 was 3 mm; and the internal diameter of the orifice 22 was 12 mm. The height H was 200 mm. The thickness of the froth layer in the flotation column was 200 mm and the four discs were located on a plane a distance 100 mm below the overflow lip 10 of the column. The wash water flow rate was in the range 3 to 10 L/min, corresponding to superficial velocities between 0.07 to 0.24 cm/s. The wash water contained coal particles up to 2 mm in diameter, which were able to flow freely through the system.

By way of comparison with known wash water distribution methods, a column of diameter 300 mm, a slurry of coal with a top size of 180 microns was subjected to flotation at a continuous flow rate of 42 litres/min. The solids concentration was 10 percent by weight, and the feed ash content was 23 percent (dry basis). Diesel fuel (0.5 kg/tonne) was used as collector and as frother, methyl isobutyl carbinol (MIBC, 15 ppm) was added to the feed. Frother was added to the wash water at the same concentration as in the feed to flotation. The froth depth was 200 mm. Two types of wash water distributor were tested: The first was a conventional tray extending over the surface of the froth and mounted 300 mm above the overflow lip of the flotation column. The base of the tray was pierced with holes of diameter 5 mm, on a triangular pitch of base dimension 110 mm. The second was a distributor as described above according to the embodiment shown in FIG. 3, mounted so that the disc 24 was at a depth of 100 mm below the overflow lip of the flotation column. In the absence of wash water, the flotation product had an ash content of 10.6 percent, dry basis. When wash water was applied through the perforated tray at a flow rate corresponding to a superficial velocity of 0.13 cm/s, the ash content of the flotation product was 10.1 percent. Using the distributor constructed according to this invention, at the same wash water flowrate, the product ash content was 8.4 percent. The decrease in ash content using the present invention represents a considerable marketing advantage in the production of energy and metallurgical coals.

What is claimed is:

1. Apparatus for introducing wash water into a flotation froth in a flotation separation system, said apparatus comprising:

a supply element including a downwardly facing nozzle forming a downwardly plunging jet of wash water directed by the nozzle, arranged to receive a supply of wash water to the apparatus, a director element including a substantially horizontal plate located below the nozzle such that the jet impinging on the plate is directed outwardly in one or more substantially horizontal sheets, and a location element arranged to position the substantially horizontal sheet or sheets at a predetermined depth within the flotation froth, wherein the plate is located below the nozzle by way of a rod extending vertically upwardly from the plate and passing through the nozzle.

2. Apparatus as claimed in claim 1 wherein the rod is vertically adjustable relative to the nozzle forming the location means arranged to position the substantially horizontal sheet at the predetermined depth within the flotation froth.

3. Apparatus for introducing wash water into a flotation froth in a flotation separation system, said apparatus comprising:

supply means arranged to receive a supply of wash water to the apparatus;

director means configured to direct the supply of wash water such that it is ejected from the apparatus in use in one or more substantially horizontal sheets; and location means arranged to position the substantially horizontal sheet or sheets at a predetermined depth within the flotation froth;

wherein the supply means further comprises a substantially vertically orientated pipe communicating with a chamber at a lower end of the pipe, the chamber including one or more horizontally extending slots in a wall of the chamber through which the stream of wash water is ejected in one or more substantially horizontal sheets; and wherein the chamber is formed from a downwardly concave upper plate, and a lower plate of corresponding size, arranged with their peripheries aligned and spaced apart by a small gap forming the horizontally extending slot.

4. Apparatus as claimed in claim 3 wherein one or both of the plates are formed of flexible material allowing the slot to expand as required to eject particles contained in the wash water passing therethrough.

5. The apparatus of claim 3, wherein the lower plate is an upwardly concave plate.

6. The apparatus of claim 3, wherein the upper plate is an upper disk and the lower plate is a lower disk.

7. Apparatus for introducing wash water into a flotation froth in a flotation separation system, said apparatus comprising:

a supply element arranged to receive a supply of wash water to the apparatus;

a director element configured to direct the supply of wash water such that it is ejected from the apparatus in use in one or more substantially horizontal sheets; and a location element arranged to position the substantially horizontal sheet or sheets at a predetermined depth within the flotation froth;

wherein the supply element further comprises a substantially vertically orientated pipe communicating with a chamber at a lower end of the pipe, the chamber including one or more horizontally extending slots in a wall of the chamber through which the stream of wash water is ejected in one or more substantially horizontal sheets; and wherein the chamber is formed from a downwardly concave upper plate, and lower plate of corresponding size, arranged with their peripheries aligned and spaced apart by a small gap forming the horizontally extending slot.

8. The apparatus of claim 7, wherein the lower plate is an upwardly concave plate.

9. The apparatus of claim 7, wherein the upper plate is an upper disk and the lower plate is a lower disk.

* * * * *